US005145335A

United States Patent [19]

Abelen et al.

[11] Patent Number: 5,145,335

[45] Date of Patent: Sep. 8, 1992

[54] LOW-NOISE VACUUM PUMP

[75] Inventors: Thomas Abelen; Hans-Peter Berges; Gustav Boley; Winfried Kaiser, all of Cologne, Fed. Rep. of Germany

[73] Assignee: Leybold AG, Hanau, Fed. Rep. of Germany

[21] Appl. No.: 704,524

[22] Filed: May 24, 1991

[30] Foreign Application Priority Data

May 29, 1990 [DE] Fed. Rep. of Germany ..... 4017193

[51] Int. Cl.[5] ..... F04B 17/00

[52] U.S. Cl. ..... 417/410; 417/423.14

[58] Field of Search ..... 417/410, 423.14; 418/181

[56] References Cited

U.S. PATENT DOCUMENTS

| | | | |
|---|---|---|---|
| 4,447,192 | 5/1984 | Tuckey | 417/410 |
| 4,762,472 | 8/1988 | King | 417/410 |
| 4,780,063 | 10/1988 | Tuckey | 417/410 |
| 4,806,083 | 2/1989 | LaGrange et al. | 417/423.14 |
| 4,950,133 | 8/1990 | Sargent | 417/423.14 |

*Primary Examiner*—Richard A. Bertsch
*Assistant Examiner*—Alfred Basichas
*Attorney, Agent, or Firm*—Spencer, Frank & Schneider

[57] ABSTRACT

A vacuum pump includes a first pump housing defining a pumping chamber; a pump rotor received in the pumping chamber; a drive motor operatively connected to the pump rotor; an oil casing receiving the first pump housing; and a second pump housing surrounding the first pump housing and the drive motor.

7 Claims, 3 Drawing Sheets

LOW-NOISE VACUUM PUMP

CROSS REFERENCE TO RELATED APPLICATION

This application claims the priority of German Application No. P 40 17 193.0 filed May 29, 1990, which is incorporated herein by reference.

BACKGROUND OF THE INVENTION

This invention relates to a vacuum pump having a housing, a drive motor and an oil casing.

Vacuum pumps, particularly oil-lubricated, rotary vane vacuum pumps have low-noise characteristics provided that they are driven with a low rpm, that they have a relatively large mass and that the coolant air stream is weak. Further, to enhance low-noise characteristics, the "oil-knock" (caused by compression in the pumping chamber, particularly in the final pressure phase) is avoided by the admixture of leakage air.

The above-outlined measures, however, are inconsistent with the low-cost manufacture and good power data of the vacuum pump. Vacuum pumps operating at low rpm's and weak coolant air flow have a relatively low power density, that is, they have a large structural volume. An elimination of the oil-knock by the admixture of leakage air adversely affects the final pressure.

SUMMARY OF THE INVENTION

It is an object of the invention to provide an improved vacuum pump of the above-outlined type which is economical to manufacture, which has good power data and yet has superior low-noise characteristics.

This object and others to become apparent as the specification progresses, are accomplished by the invention, according to which, briefly stated, the vacuum pump has an additional, outer housing, preferably constituted by a hood or cover.

An outer housing provided according to the invention has a reducing effect not only on noises generated by the pumping body itself but also as concerns the noises generated by the coolant air flow, in case the housing simultaneously serves for guiding the air. It is of particular advantage that, with the aid of the hood, the coolant air can be purposely guided to the surfaces to be cooled. It is generally known to generate an air flow by the motor fan in small rotary vane pumps and to use such air for cooling the pump. Without particular guide arrangements, however, the risks are high that the coolant air flow is dispersed (destroyed) by the structure. Such risks are eliminated by the invention. Further, the coolant air distribution is independent from the location of installation of the pump.

DESCRIPTION OF THE PREFERRED EMBODIMENT

Figure 1:
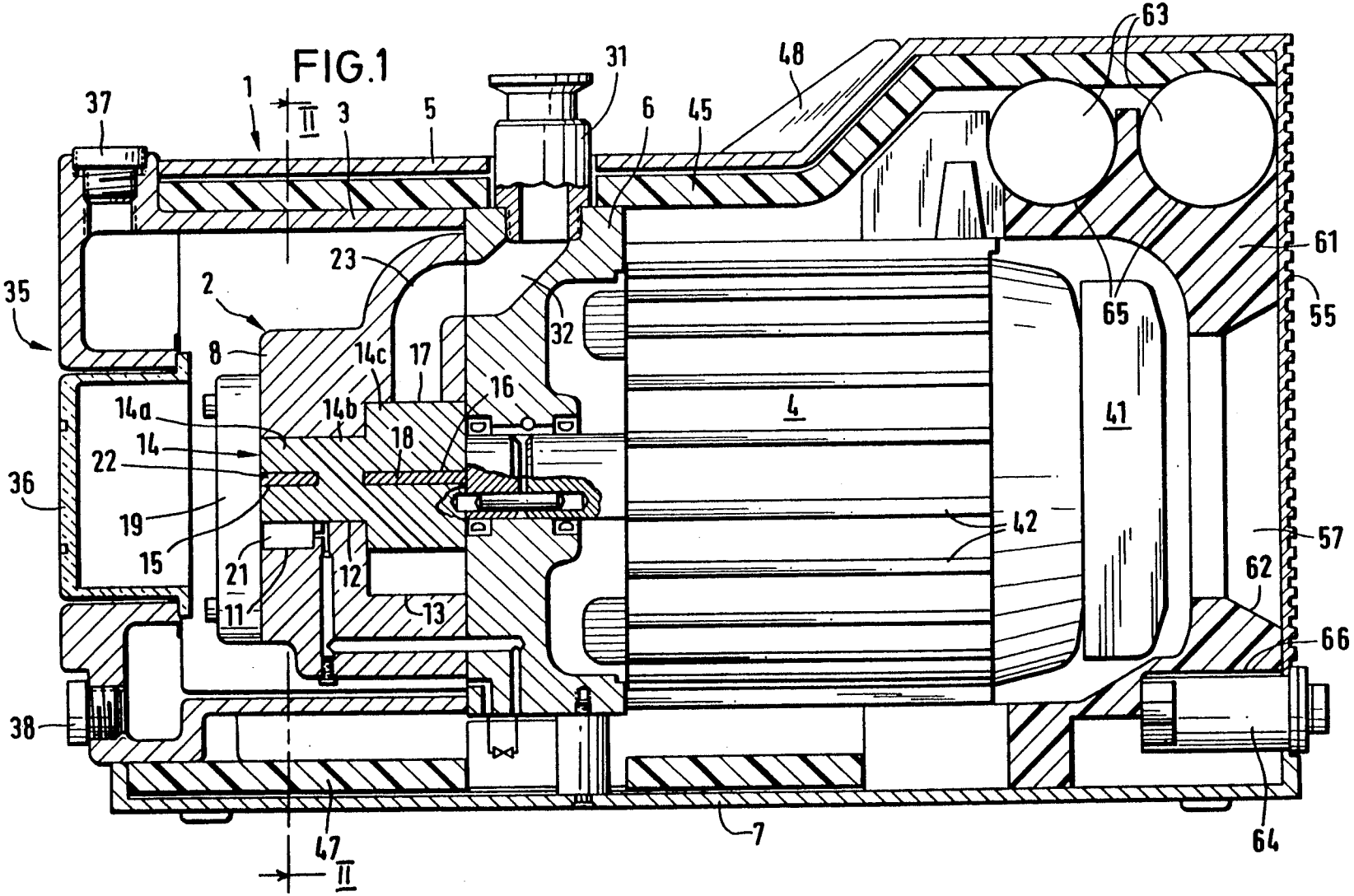
FIG. 1 is an axial sectional view of a preferred embodiment, taken along line I—I of FIG. 2.
Figure 2:
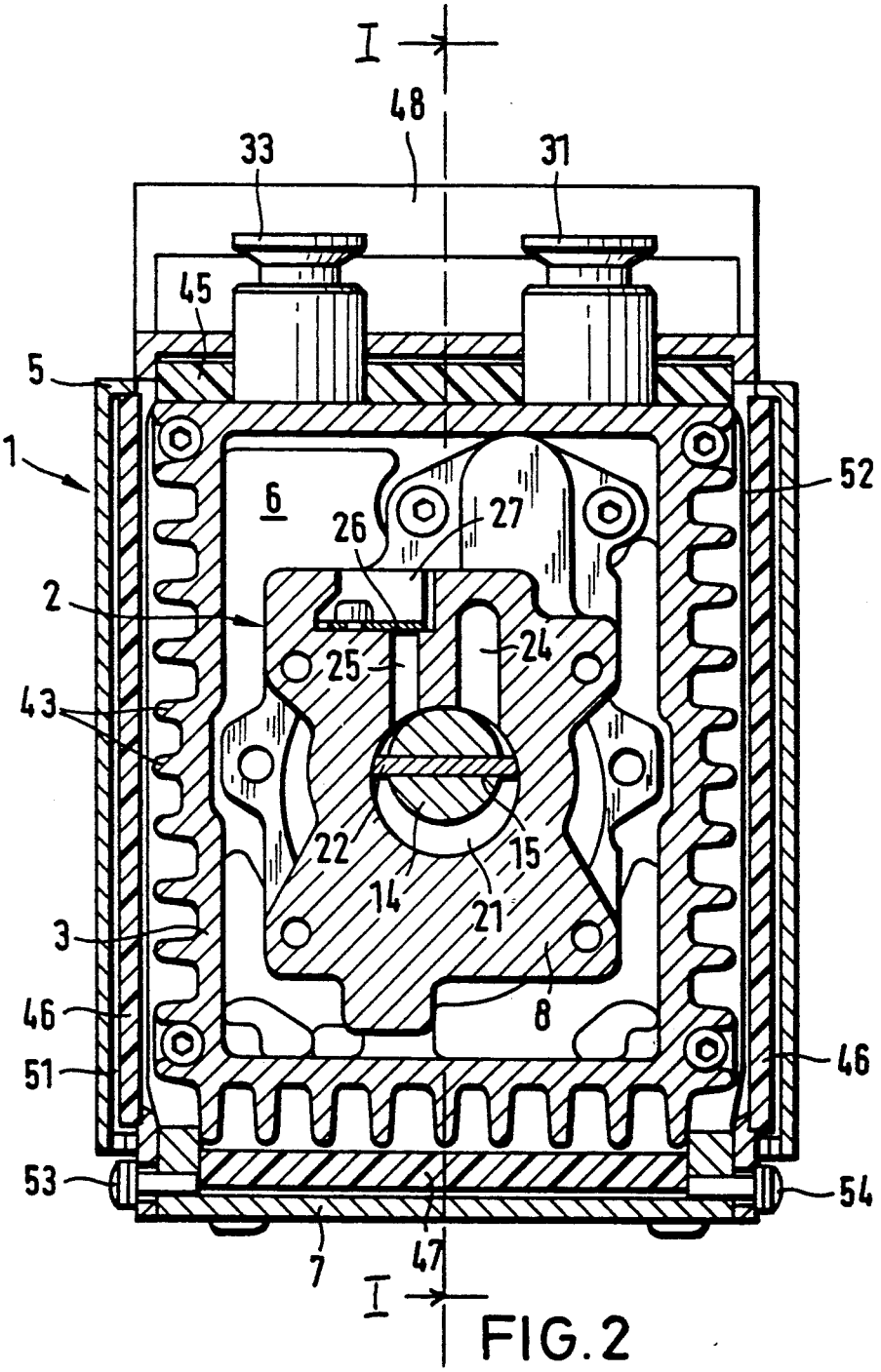
FIG. 2 is a sectional view taken along line II—II of FIG. 1.

Turning to FIGS. 1 and 2, the two-stage rotary vane vacuum pump shown therein and generally designated at 1 includes a pump housing 2, an oil casing 3 surrounding the pump housing 2, a drive motor 4 and an outer housing or pump cover (hood) 5. The pump housing 2 and the drive motor 4 are mounted on a separating shield 6 which, in turn, is secured to a base plate 7 supported on a floor.

The pump housing 2 includes a one-piece pump ring 8 which has a throughgoing opening having three consecutive zones 11, 12 and 13 of different configurations. In the ring opening 11, 12, 13 there is disposed a one-piece rotor assembly 14 which has axially consecutive parts 14*a*, 14*b* and 14*c*. The two outer parts 14*a* and 14*c* are provided with vane slots 15, 16 at their end faces and form the armature of the high vacuum stage (hereafter "HV-stage") and the pre-vacuum stage (hereafter "PV-stage"), respectively.

The mid portion 14*b* of the rotor assembly 14 corresponds in length and diameter to the mid zone 12 of the opening of the pump ring 8 such that this zone functions as a slide bearing for the rotor assembly 14. The opening zone 13 of the pump ring 8 is enlarged relative to the zone 12 and constitutes, together with the shield 6, the pump chamber 17 of the HV-stage in which the rotor part 14*c*, carrying a vane 18, is disposed. The zone 11 of the pump ring 8 constitutes, together with a frontal plate 19, the pump chamber 21 of the PV-stage in which the rotor part 14*a*, carrying a vane 22, is disposed. The HV-stage has an inlet channel 23, and a channel 24 extends from the outlet of the HV-stage to the inlet of the PV-stage. The PV-stage has an outlet channel 25, associated with an outlet check valve 26 which is situated at the upper part of the pump housing 2 and, in case of a pump breakdown, preserves the vacuum in the vessel under evacuation. A depression 27 is provided in the top face of the housing 2 for serving as an intermediate oil sump during the operation of the vacuum pump, as it will be explained later.

An inlet nipple 31 of the vacuum pump is secured to the shield 6 in which a port 32 is provided, connecting the inlet nipple 31 to the inlet channel 23 of the HV-stage. The shield 6 also carries an outlet nipple 33 which is connected by a non-illustrated port that is similar to the port 32, with the inner space of the oil casing 3.

Figure 3:
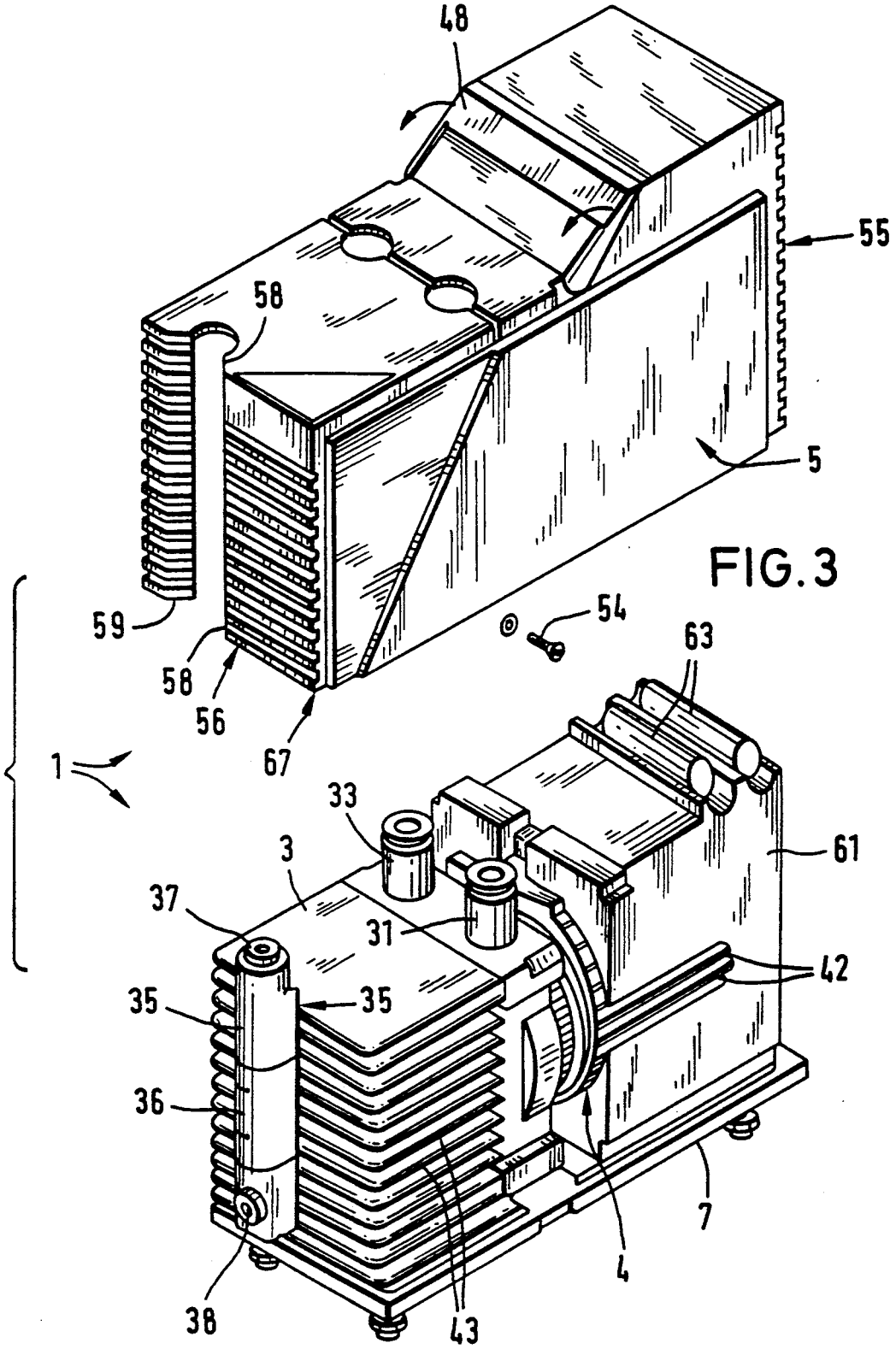
FIG. 3 is an exploded perspective view of the preferred embodiment.

Also referring to FIG. 3, the oil casing 3 has an end face structure 35, whose central portion 36 is transparent and serves for monitoring the oil level in the oil casing 3. The narrow, vertical end face structure 35 has an approximately semicircular horizontal cross section, whose wide side is oriented towards the oil casing 3. The end face structure 35 extends over the entire height of the oil casing 3 and is provided with an oil filling opening 37 and an oil drain 38.

The motor 4 is provided with a blower 41 at its end face oriented away from the pump structure proper. The cold air flow generated by the blower 41 serves for cooling both the motor 4 and the pump. The housing of the motor 4 and the oil casing 3 are both provided with axially or horizontally oriented cooling ribs 42 and 43, respectively.

Referring once again to FIG. 3, the hood 5 covers the oil casing 3 and the drive motor 4 and is provided with sound dampening layers 45, 46 made of soft foam to thus ensure an effective suppression of sounds derived from body vibrations. The free zones of the base plate 7 are also covered by a dampening layer 47.

A handle 48 is pivotally mounted on the hood 5 and is secured to tie bars 51, 52 which in turn are releasably attached by screws 53, 54 to the base plate 7. If the pump is carried by the handle 48, the tie bars 51, 52 take up the required load (carrying forces) so that the other zones of the hood 5 need not have load-carrying strength and stability.

The front faces 55, 56 of the hood 5 are ribbed, and coolant air passages are provided by leaving the space between the ribs partially open. A coolant air inlet opening 57 provided in the hood 5 faces a fan 41 mounted on the shaft of the drive motor 4. The fan 41 is situated at that end of the motor 4 which is oriented away from the pump proper. The cooling air passes through the hood 5 and exits at the end face 56 thereof. The end face 56 has, laterally of end structure 35, vertical, inwardly angled portions 58, 59 which, together with a lower slot 67, are provided with cooling air passages. This arrangement ensures that the coolant air flows essentially entirely around the oil casing 3. Further, the outflowing cooling air first impinges on the end construction 35 which projects outwardly from the housing 5 through a vertical, elongated opening provided therein, and on the floor and is deflected thereby which further contributes to noise suppression.

In the zone of the generally rectangular oil casing 3 the cooling air channels are formed by cooling ribs 43 provided on the outer faces of the oil casing 3 and the inner wall of the lining 46 of the hood 5. In order to effectively cool the cross-sectionally circular drive motor 4, a shaped component 61 is provided which is preferably made of hard foam. In the zone of the inlet opening 57 the component 61 has an inner wall face 62 which defines the air inlet opening 57 of the hood 5 and through which the cooling air gains access to the fan 41. The shaped component 61 also assumes the function of a fan hood and thus such a component is not needed as a separate, independent part. The shaped component 61 straddles the motor 4 and forms with its ribs 42 the required cooling air channels. After cooling the motor 4, the cooling air is introduced into the zone of the oil casing 3 and exits through the slot 67 in the zone of the curved end construction 35.

The mounting and insulation of electrical components such as condensers 63, cables, a switch 64 and the like are generally involved with significant expense in vacuum pumps, particularly if for one pump different motor variants are used. Since the shaped part 61 is made of an electrically insulating material, it may be used for supporting the electrical components. For this purpose, in the shaped body 61 cutouts or recesses 65, 66 are provided which, together with the hood 5 form hollow spaces. After positioning the hood 5, a secure and electrically insulating support for the electrical components is ensured.

It will be understood that the above description of the present invention is susceptible to various modifications, changes and adaptations, and the same are intended to be comprehended within the meaning and range of equivalents of the appended claims.

What is claimed is:

1. A vacuum pump comprising (a) a first pump housing defining a pumping chamber;

(b) a pump rotor received in the pumping chamber;

(c) a drive motor operatively connected to said pump rotor and having an outer surface;

(d) an oil casing receiving said first pump housing and having an outer surface;

(e) a second pump housing surrounding said first pump housing and said drive motor; said second pump housing having inner wall faces and an air inlet opening;

(f) a blower operatively connected to said drive motor and being arranged at a side thereof facing away from said first pump housing; said air inlet opening of said second pump housing facing said blower;

(g) cooling ribs provided on said outer surfaces of said drive motor and said oil casing; said cooling ribs forming, with said inner wall faces of said second pump housing, channels for guiding cooling air drawn in through said inlet opening by said blower; and (h) a shaped component disposed about said blower and surrounded by said second pump housing; said shaped component including means for positively guiding cooling air drawn in through said inlet opening by said blower; said shaped component being of an electrically insulating material and comprising cutouts for accommodating electric components; said cutouts, together with said inner wall faces of said second pump housing, defining cavities for form-fittingly receiving and supporting electric components therein.

2. A vacuum pump as defined in claim 1, wherein said second pump housing has lateral and top walls; said second pump housing surrounding said oil casing and said drive motor laterally and from above.

3. A vacuum pump as defined in claim 1, further comprising a sound dampening lining provided at said inner wall faces of said second pump housing.

4. A vacuum pump as defined in claim 1, further comprising a carrying handle mounted on said second pump housing; a base plate supporting said oil casing and said first pump housing; tie bars releasably connected to said base plate; said carrying handle being load-transmittingly coupled to said tie bars.

5. A vacuum pump as defined in claim 2, further wherein said second pump housing comprises first and second opposite end faces; said air inlet opening being provided in said first end face; further wherein said second pump housing has an air outlet opening in said second end face thereof.

6. A vacuum pump as defined in claim 5, wherein said oil casing comprises a vertical elongated projection having a generally semicircular horizontal cross section; said projection extending outwardly from said second end face of said second pump housing through a vertical opening therein; said second pump housing having two inwardly angled portions laterally adjoining said projection at a lower part thereof and bounding said outlet opening; said outlet opening being downwardly oriented for causing air drawn in by said blower to exit from the pump in a downward direction.

7. A vacuum pump as defined in claim 1, further wherein said shaped component forms air channels together with the cooling ribs provided on said drive motor.

* * * * *